US009724817B2

(12) United States Patent
Hongquan

(10) Patent No.: US 9,724,817 B2
(45) Date of Patent: Aug. 8, 2017

(54) TWO-POSITION DRIVER

(71) Applicant: Meridian International Co., Ltd., Songjiang, Shanghai (CN)

(72) Inventor: Zhang Hongquan, Shanghai (CN)

(73) Assignee: Meridian International Co., Ltd., Songjiang, Shanghai (CN)

( * ) Notice: Subject to any disclaimer, the term of this patent is extended or adjusted under 35 U.S.C. 154(b) by 251 days.

(21) Appl. No.: 14/805,665

(22) Filed: Jul. 22, 2015

(65) Prior Publication Data

US 2016/0107304 A1 Apr. 21, 2016

(30) Foreign Application Priority Data

Oct. 20, 2014 (CN) ..... 2014 1 0559109

(51) Int. Cl.

| | |
|---|---|
| ***B25G 1/06*** | (2006.01) |
| ***B25B 23/16*** | (2006.01) |
| ***B25B 15/04*** | (2006.01) |
| ***B25G 1/08*** | (2006.01) |

(52) U.S. Cl.
CPC ..... *B25G 1/066* (2013.01); *B25B 15/04* (2013.01); *B25G 1/085* (2013.01)

(58) Field of Classification Search
CPC ..... B25G 1/066; B25G 1/085; B25B 15/04
See application file for complete search history.

(56) References Cited

U.S. PATENT DOCUMENTS

| | | | | |
|---|---|---|---|---|
| 1,309,281 | A * | 7/1919 | Forbes | B25G 1/085 81/490 |
| 5,782,150 | A * | 7/1998 | Huang | B25G 1/085 206/234 |
| 6,243,902 | B1 * | 6/2001 | Huang | B25G 1/085 7/165 |
| 6,308,599 | B1 * | 10/2001 | Fu-Hui | B25G 1/066 81/177.4 |
| 6,321,856 | B1 | 11/2001 | Alsruhe | |
| 7,380,660 | B2 * | 6/2008 | Lin | B25G 1/085 206/375 |
| 7,555,972 | B1 * | 7/2009 | Chen | B25G 1/085 81/177.4 |
| 7,866,235 | B2 * | 1/2011 | Hi | B25G 1/066 81/177.7 |
| 9,028,505 | B2 * | 5/2015 | Witt | A61B 17/8875 29/525.11 |
| 9,089,955 | B2 * | 7/2015 | Johnson | B25B 23/0028 |
| 2009/0188053 | A1 * | 7/2009 | Chen | B25B 13/56 7/167 |
| 2010/0116104 | A1 * | 5/2010 | Hung | B25G 1/085 81/490 |
| 2016/0318162 | A1 * | 11/2016 | Chen | B25B 15/001 |
| 2016/0339564 | A1 * | 11/2016 | Chen | B25G 1/085 |

* cited by examiner

*Primary Examiner* — David B Thomas
(74) *Attorney, Agent, or Firm* — Shuttleworth & Ingersoll, PLC; Jason Sytsma

(57) ABSTRACT

A driver with two operating positions has a handle with a first shell and a second shell connected that can open with respect to each other. Attached to one of the handle portions is a working end that is configured to rotate substantially, generally ninety degrees between a first position with a working end extending along an axis that is longitudinal with the handle and a second position with the working end extending along an axis that is transverse to the handle.

17 Claims, 7 Drawing Sheets

TWO-POSITION DRIVER

This application claims priority to Chinese Application No. CN201410559109.9 filed Oct. 20, 2014, the contents of which are hereby incorporated by reference herein.

BACKGROUND

The present disclosure relates to a ratcheting driver and, more specifically, to a two-position ratcheting driver.

Ratcheting drivers are utilized by general consumers as an easier alternative to a manual drivers and a less expensive and lighter alternative to a power driver. Ratcheting drivers come in a couple of handle orientations, including the T-handle shape that is comfortably held in the palm of the users while allowing the user easily to apply downward pressure on the work piece, and the stick type driver that can be easily gripped by the user while occupying a smaller work area.

Both of the aforementioned styles have preferred uses depending on the situation. While these tools appear to be satisfactory for their intended purpose, what is needed is a more useful tool.

SUMMARY

A driver with two operating positions is disclosed. The driver has a handle with a first shell and a second shell connected by a hinge that can open with respect to each other. Attached to one of the handle portions is a working end that is configured to rotate substantially, generally ninety degrees between a first position with a working end extending along an axis that is longitudinal with the handle and a second position with the working end extending along an axis that is transverse to the handle.

A guide groove is positioned on one of the handle portions and configured to cooperate with a first projection on the working end to guide the working end between the respective positions. The driver has three locking mechanisms to secure the working end to the handle portion. A projection is included on the working end and is configured to engage a recess in the other handle portion. A bar that forms part of the working end engages a positioning hole in the other handle portion. Another projection on the working end engages a detent in the other handle portion. The three locking mechanisms cooperate to secure the working end of the driver to the handle for operation.

The working end also has a long slot in its bar in which a connector is passed to combine the working end to the handle portion. The working end can slide up and down with respect to the connector to allow the working end to move to locking positions once the working end is positioned in the respective first and second positions.

The driver can have other features and accessories, such as a bi-directional ratcheting mechanism on the working end to allow the handle to rotate with respect to a tool receiving recess. The driver can also be provided without a ratcheting mechanism. The driver can also have a storage area inside one of the handle portions to receive interchangeable driver heads with various specifications.

DETAILED DESCRIPTION

Figure 1:
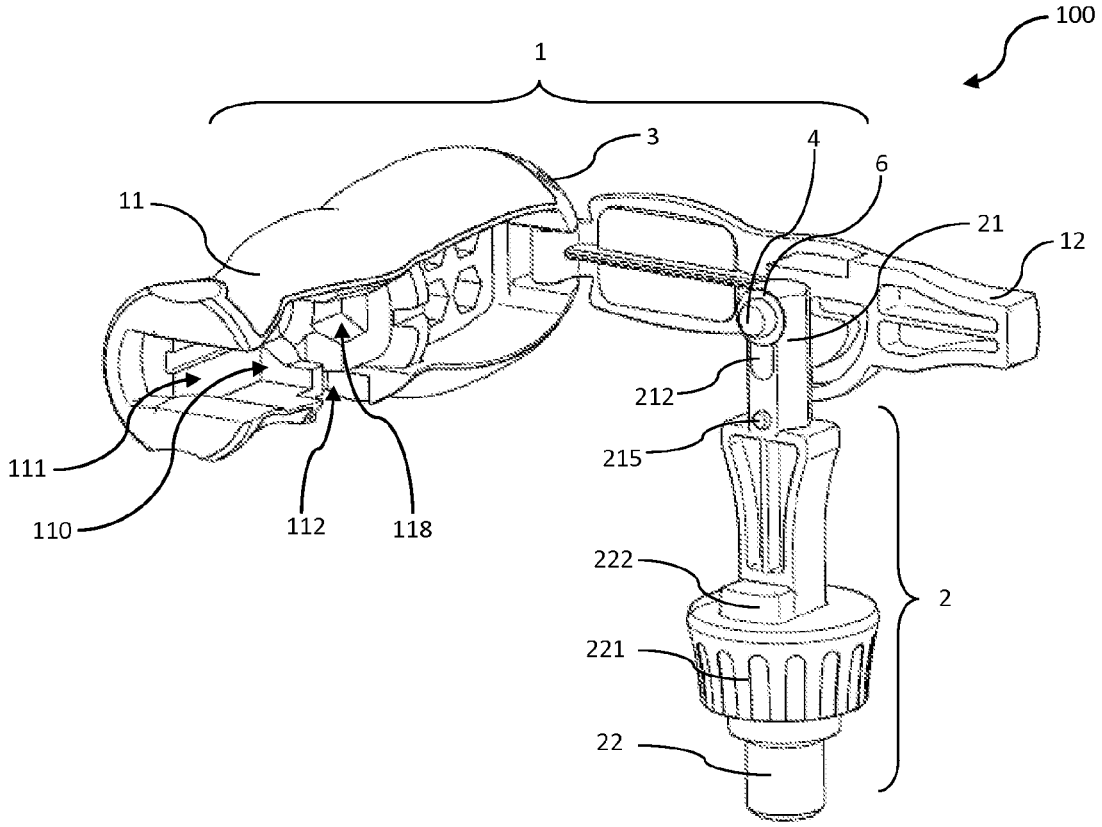
FIG. 1 is a perspective view of a two-position driver with its handle opened to illustrate movement between the two positions.

FIG. 1 shows a driver 100 comprising of a handle 1 and a working end 2 that has two operating positions. Handle 1 includes a first shell 11 hinge-connected to a second shell 12 and made rotatable by a pin 3 that connects first shell 11 to a knuckle 13 on second shell 12. Working end 2 is connected to the second shell 12 by a connector 4, which allows working end 2 to rotate ninety degrees with respect to second shell 12 between a transverse and longitudinal position. Connector 4 can be any type of fastener including bolt with a washer 6.

Figure 2:
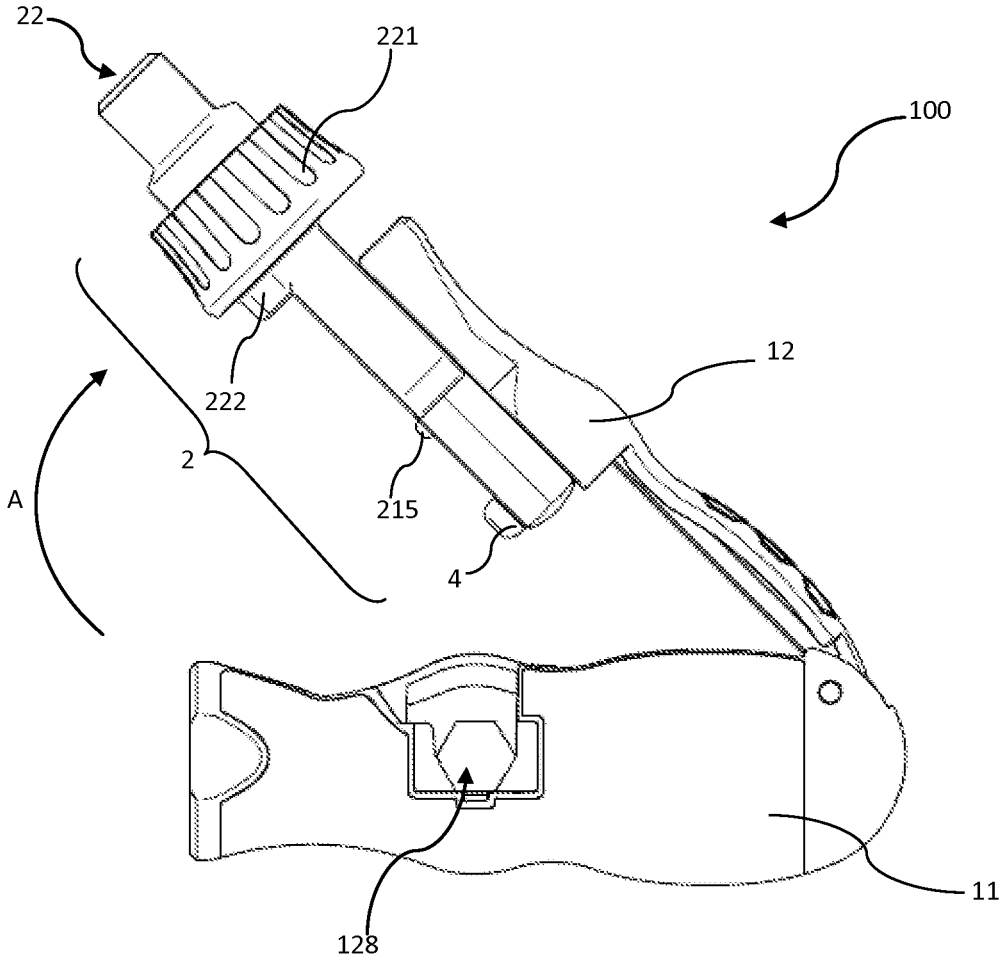
FIG. 2 is a top view of the driver of FIG. 1 with the working end of the driver rotated with respect to the handle in the "A" plane.
Figure 4:
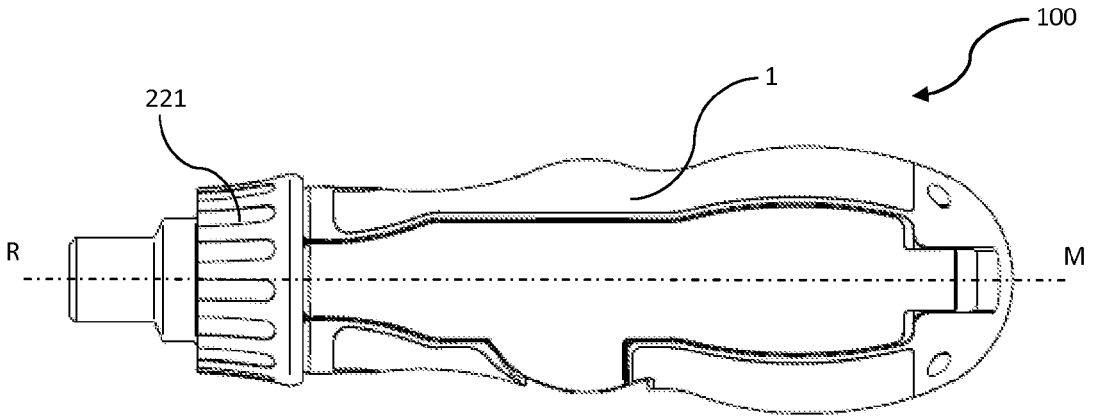
FIG. 4 is the driver of FIG. 1 in a longitudinal, first operating position.
Figure 5:
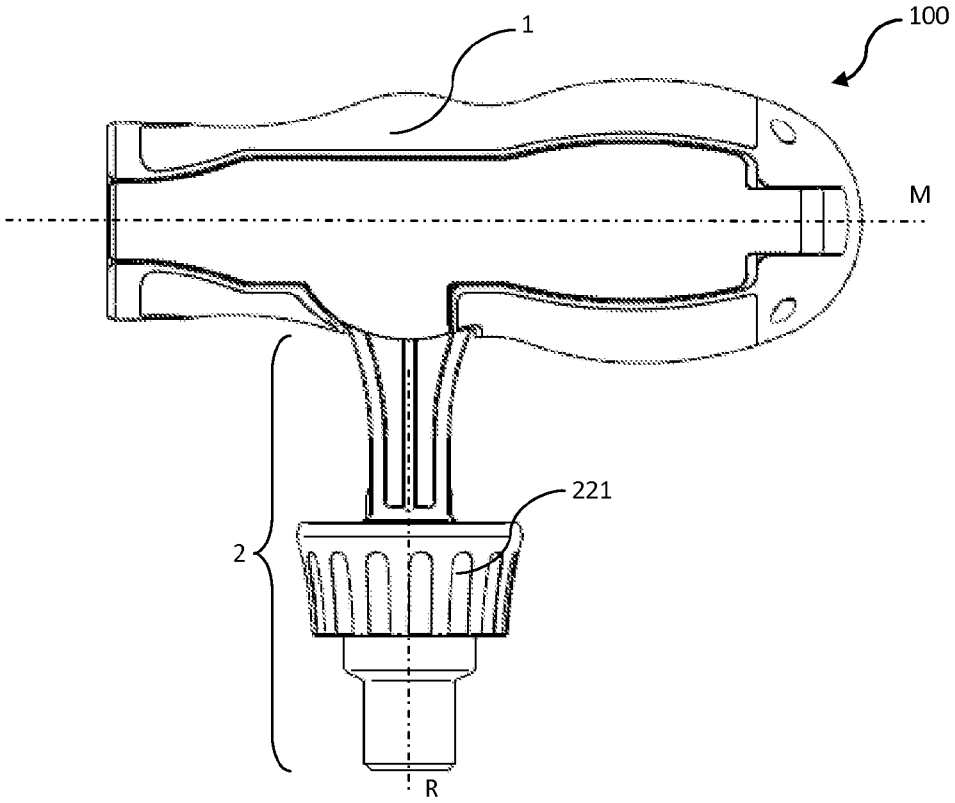
FIG. 5 is the driver of FIG. 2 in a transverse, second position.

The configuration of driver 100 in the two positions is more clearly shown in FIGS. 2, 4-5. FIG. 2 shows the relative rotation about plane "A" of first shell 11 with respect to second shell 12 with working end 2 in the longitudinal position. FIG. 4 shows an axis "R" of the working end 2 that is coaxial with the axis of the handle 1 "M". In this alignment, driver 100 is in the longitudinal position or a first operating position. FIG. 5 shows axis "R" perpendicular with axis "M". In this alignment, driver 100 is in the transverse, second operating position.

Figure 6:
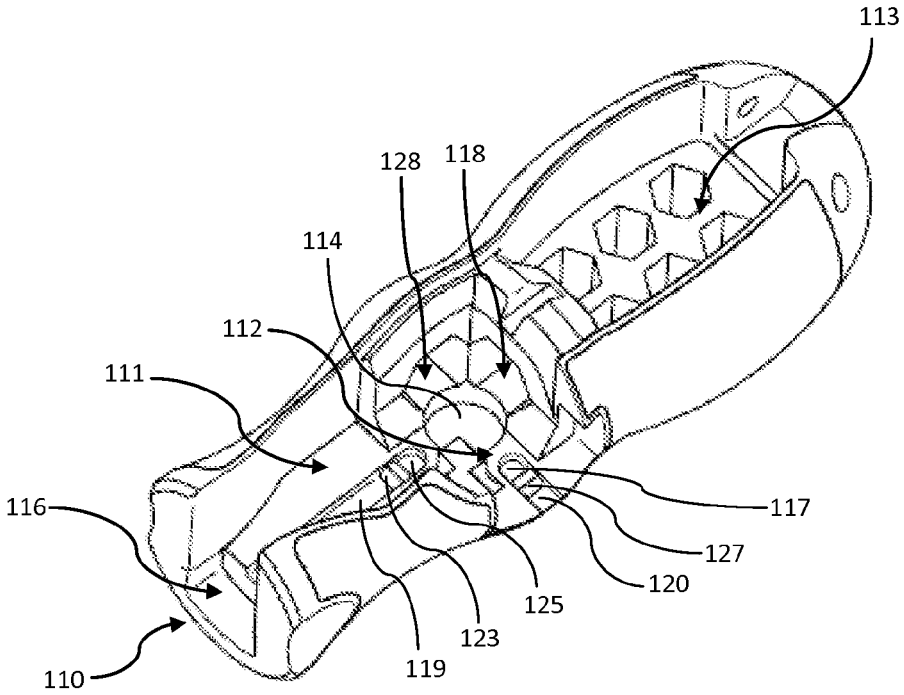
FIG. 6 is a perspective view of the inside of one of the handle portions.
Figure 10:
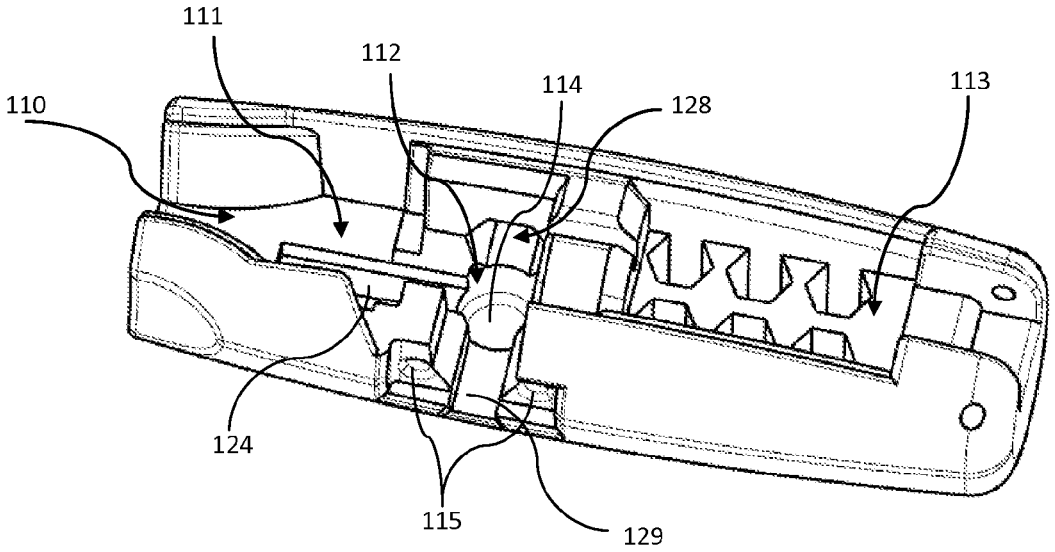
FIG. 10 is another perspective view of the handle portion shown in FIG. 6.

FIG. 6 shows first shell 11 in more detail. First shell 11 has a housing 110 with a first housing portion 111 and a second housing portion 112. When the driver 100 is in the longitudinal, first operating position, working end 2 is restrained by first housing portion 111. First housing portion 111 includes a longitudinal groove 119 followed by a bevel 123 and a detent 125 (or a single longitudinal groove 124, as shown in FIG. 10). As will be described in more detail below, longitudinal groove 119 and bevel 123 provide a path of travel for a corresponding second projection 215 on a bar 21 of working end 2. Second projection 215 is guided along longitudinal groove 119 up and over bevel 123 into engagement in detent 125 to constrain working end 2 in the longitudinal, first operating position.

Similarly, when driver 100 is in the transverse, second operating position, working end 2 is restrained by the second housing portion 112. Second housing portion 112 includes a transverse groove 120 followed by a bevel 127 and a detent 117 (or a single transverse groove 129, as shown in FIG. 10). Transverse groove 120 and bevel 127 provide a path of travel for second projection 215 on bar 21 of working end 2. Second projection 215 is guided along transverse groove 120 up and over bevel 127 into engagement with detent 117 to constrain working end 2 in the transverse, second operating position. First shell 11 also has a third housing portion 113 that receives interchangeable driver heads with various specifications, and a depression 114 to receive the head of connector 4 that combines working end 2 to second shell 12 of handle 1.

Figure 7:
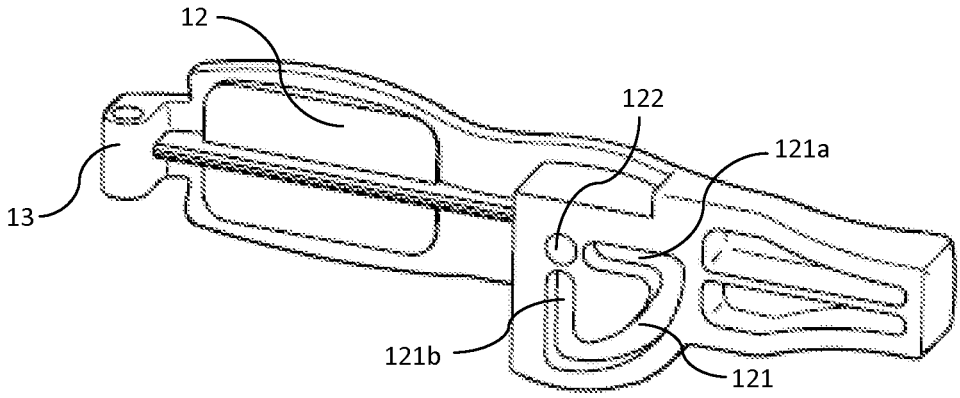
FIG. 7 is a perspective view of the second handle portion.

FIG. 7 shows second shell 12. Second shell is hinge-connected to first shell 11 with pin 3 through the holes in knuckle 13. Second shell 12 has a C-type guide groove 121 with a longitudinal portion 121*a* and a transverse portion 121*b* to guide a first projection 211 on bar 21 of working end 2.

Figure 8:
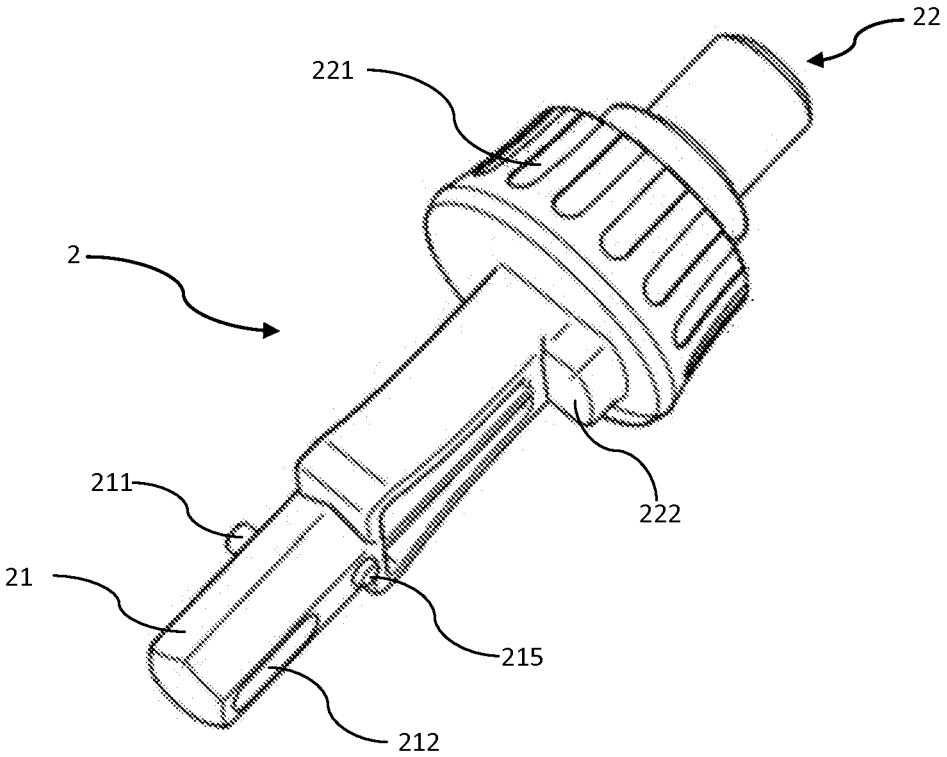
FIG. 8 is a perspective view of the working end of the driver of FIG. 1.

Working end 2 is connected to second shell 12 of handle 1 with connector 4 in hole 122. FIG. 8 shows working end 2. Working end 2 has a long slot 212 (it could be a U-shaped slot) in bar 21 to allow connector 4 to pass therethrough. The diameter or width of the long slot 212 is larger than the diameter of the threaded portion of connector 4, and smaller than the diameter of the head of the connector 4, so that connector 4 can combine working end 2 to second shell 12 of handle 1 in a manner that allows working end 2 to rotate relative to the second shell 12 and move working end 2 with respect to connector 4 by guiding long slot 212 along connector 4. First projection 211 on one side of the connecting bar 21 can slide in groove 121, to guide working end 2 between the longitudinal, first position and the transverse, second position.

Longitudinal portion 121*a* and transverse portion 121*b* of C-type guide groove 121 cooperate with long slot 212 in working end 2 so that first projection 211 on bar 21 of working end 2 can move linearly to the first locking position corresponding with first projection 211 being in longitudinal portion 121*a* or move linearly to the second locking position corresponding with first projection being in transverse portion 121*b*, and while long slot 212 is guided along connector 4.

Second projection 215 on bar 21 of working end 2 can be recessed by pressed pin, a bearing, or the like. When first shell 11 and second shell 12 are closed, second projection 215 is engaged with one of detent 125 or detent 117 corresponding with working end being in the longitudinal, first position and the transverse, second position, respectively.

Figure 9:
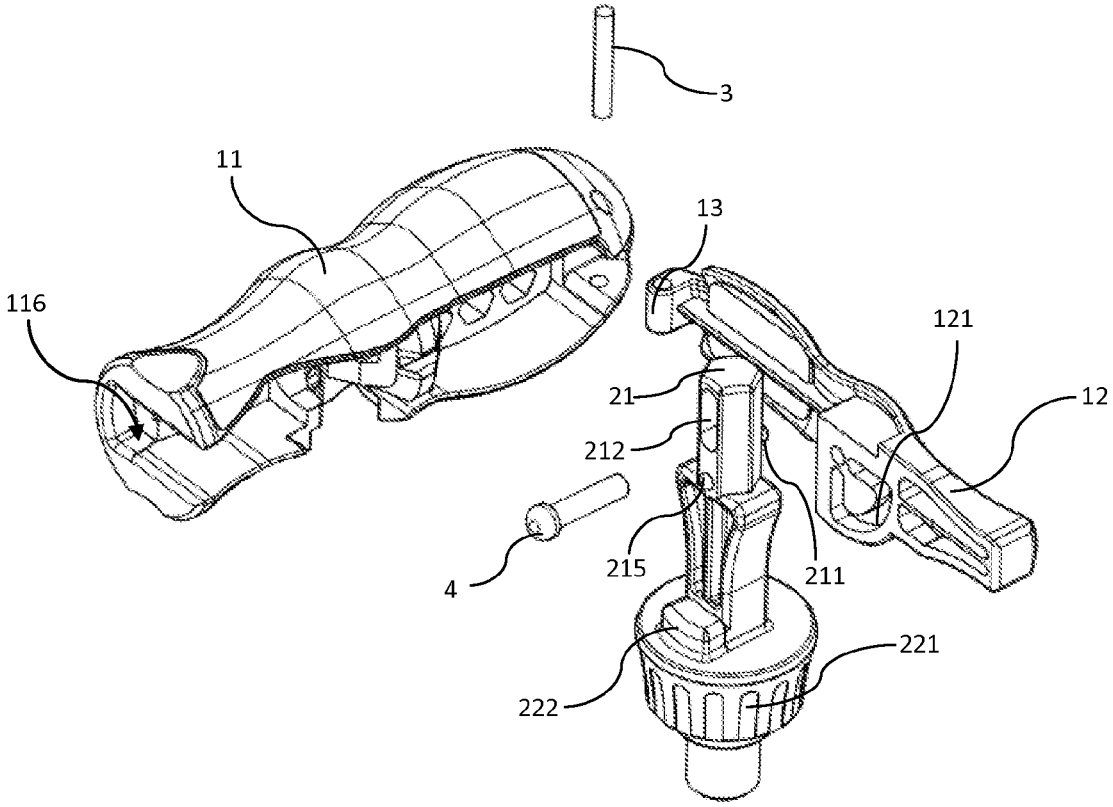
FIG. 9 is a perspective view of the driver of FIG. 1 with the pivot pins exploded from the driver.
Figure 11:
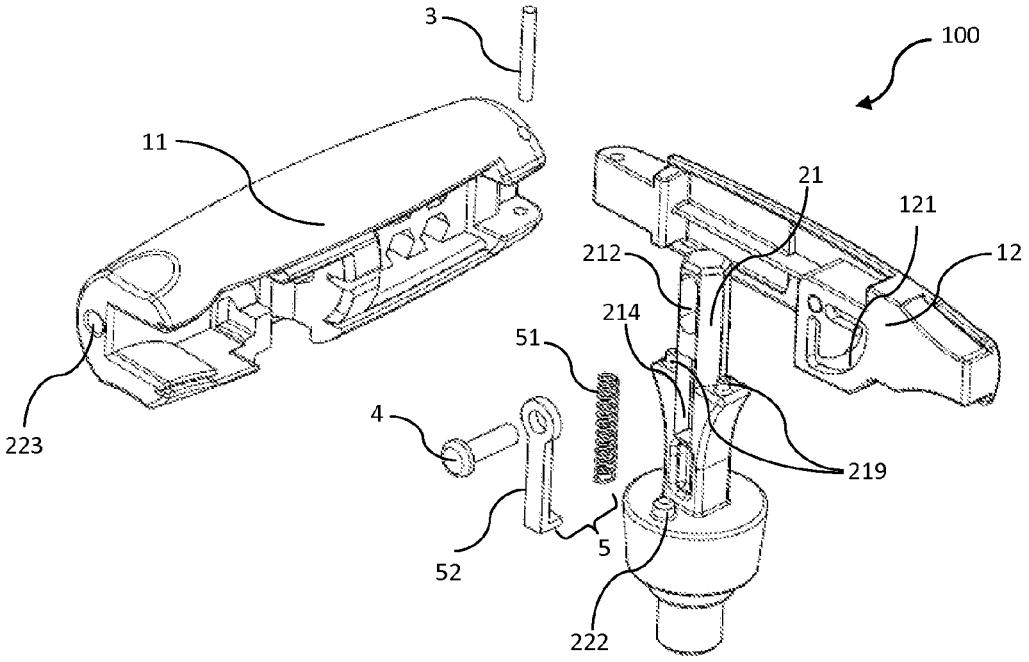
FIG. 11 is another perspective view of the driver of FIG. 1 with the pivot pins and spring exploded from the driver.

A tool receiving recess 22 on the end of working end 2 can be used to install various driver heads stored in third housing portion 113 of handle 1. FIG. 9 shows driver 100 with a bi-directional ratcheting mechanism 221 configured to allow handle 1 and bar 21 of working end 2 to rotate in a clockwise and counter clockwise direction with respect to tool receiving recess 22 of working end 2. Alternatively, driver 100 can be provided without a ratcheting mechanism, as shown in FIG. 11.

FIG. 9 shows a recess 116 on the end opposite to the pivot end of the first shell 11 that can receive a projection 222 on the working end 2. Projection 222 is engaged with the recess 116 when the driver 100 is in first operating position. Referring to FIG. 6, in the first housing portion 111, there is a longitudinal groove 119 extending longitudinally from bevel 123 to recess 116. In the second housing portion 112, there is a transverse groove 120 adjacent to and extending away from bevel 127. Bevel 123 and bevel 127 provide a path of travel to guide projection 222 from longitudinal groove 119 and transverse groove 120, respectively, up and into detent 125 and detent 117, respectively. Accordingly, longitudinal groove 119 and transverse groove 120 can be separated from bevel 123 and bevel 127, respectively, or longitudinal groove 119 can be separate from recess 116, or bevel 123 and bevel 127 can be separated from detent 125 and detent 117, respectively.

In the first operating position, first shell 11 and second shell 12 are closed, the axis "R" is coaxial with axis "M", the head of the connector 4 is received in depression 114, the second projection 215 is positioned in longitudinal groove 119. Working end 2 can be pressed inward so that second projection 215 is moved up longitudinal groove 119 over bevel 123 into detent 125 and projection 222 on the working end 2 is engaged with the recess 116 on the first shell 11 in a locking position. There is also a positioning hole 118 on an inner surface that is coaxial with longitudinal groove 119 and facing first housing portion 111 that receives bar 21 of working end 2. At this time, the working end 2 is fixed with the driver 100 in longitudinal, first operating position with three locking mechanisms to make sure working end 2 is secured to handle 1.

To move driver 100 from the longitudinal, first operating position to the transverse, second operating position, working end 2 is pulled out to disengage second projection 215 from detent 125 and bar 21 of working end 2 from positioning hole 118 and projection 222 from recess 116 in first shell 11 of handle 1 (collectively, the three locking mechanisms). This allows first shell 11 to pivot away from the second shell 12. Working end 2 can rotate clockwise until the axis "R" is perpendicular with the axis "M". First shell 11 and second shell 12 are then closed and working end 2 is pressed into engagement with the first shell 11 so that second projection 215 rides up and over bevel 127 into detent 117 and into a locking position. Working end 2 is now fixed with the driver 100 in the transverse, second operating position. There is also a positioning hole 128 on an inner surface that is coaxial with transverse groove 120 and facing second housing portion 112 that receives bar 21 of working end 2. At this time, the working end 2 is fixed with the driver 100 in transverse, second operating position with a triple lock to make sure working end 2 is secured to handle 1.

FIGS. 10 and 11 show another configuration for driver 100 with two protrusions 219 on working end 2 (see FIG. 11). Protrusions 219 correspond with a pair of detents 115 on first shell 11 (see FIG. 10). Working end 2 is pressed inward to engage protrusions 219 into the pair of detents 115 to constrain working end 2 of driver 100 in the transverse, second operating position. This embodiment also has positioning hole 128 on the inner surface and coaxial with transverse groove 120 and facing second housing portion 112 that receives bar 21 of working end 2 to triple lock working end 2 to handle 1. Working end can also have another projection 222 that corresponds with a recess 223 on first shell 11 of handle 1 that can constrain driver 100 in the longitudinal, first operating position. Projection 222 could also be a raised step that surrounds the lower end of bar 22 above bi-directional ratcheting mechanism 221 with a generally circular top profile (as viewed from the "R" axis) and configured to engage a corresponding recess 116 that has a generally round profile to secure from movement working end 2 from lateral movement near bi-directional ratcheting mechanism 221 and tool receiving recess 22.

Figure 3:
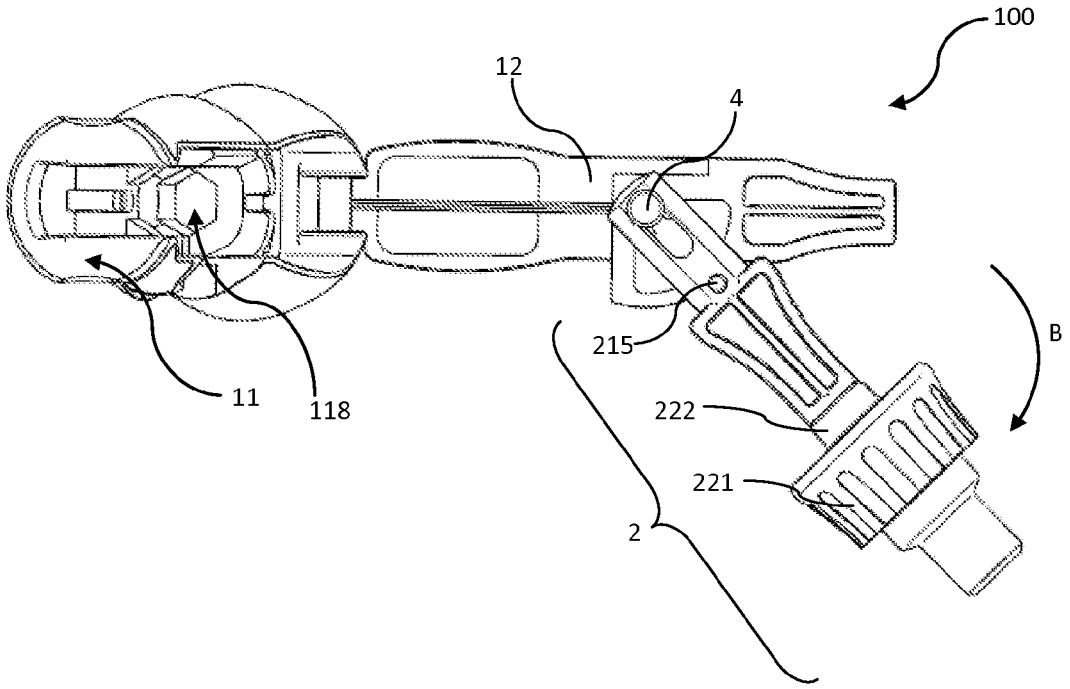
FIG. 3 is a bottom view of the driver of FIG. 1 with the working end rotated with respect to the two handle portion in the "B" plane.

Driver 100 can also include a locking device 5. FIG. 11 shows a receiving slot 214 under long slot 212 to receive lock devise 5. Locking devise 5 comprises a resilient member 51 and a locating member 52. The resilient member 51 can be a spring. Locating member 52 can be L-shaped with a hole on one end to allow connector 4 to pass through. The other end of locating member 52 extends into receiving slot 214 and contacts with the inner surface that is parallel with the plane B (see FIG. 3). Resilient member 51 is received in receiving slot 214 with one end in contact with the upper surface of receiving slot 214 and the other end in contact with locating member 52. Locating member 52 can be received in longitudinal groove 119 when first shell 11 and second shell 12 of handle 1 are closed.

The Various aspects of any of the embodiments can be combined in different combinations than the ones shown to create new embodiments that fall within the scope of the appended claims.

While the present invention has been particularly shown and described with reference to exemplary embodiments thereof, it should be understood by those of ordinary skill in the art that various changes, substitutions and alterations can be made herein without departing from the scope of the invention as defined by appended claims and their equivalents. The invention can be better understood by reference to the following claims. For purpose of claim interpretation, the transitional phrases "including" and "having" are intended to be synonymous with the transitional phrase "comprising."

What is claimed is:

1. A driver with two operating positions comprising:

a handle having a first shell and a second shell that can open with respect to each other;

a working end pivotally combined to one of the first shell and the second shell and configured for movement in substantially ninety degrees between a first position with the working end extending along an axis that is longitudinal with the handle and a second position with the working end extending along an axis that is transverse with the handle.

2. The driver of claim 1, and further comprising a hinge connecting the first shell and the second shell.

3. The driver of claim 2, wherein one of the first shell and the second shell of the handle has a recess on the end opposite to the hinge corresponding with a projection on the working end, and the recess can receive the projection.

4. The driver of claim 1, and further comprising a first projection on the working end and a guide groove on one of the first shell and the second shell, wherein the first projection is positioned in the guide groove to guide the working end between the first position and the second position.

5. The driver of claim 4, and further comprising a connector, and wherein the working end further comprises a bar with a long slot, and wherein the connector extends through the long slot to connect the working end to one of the first shell and the second shell so that the working end can rotate between the first position and the second position and move linearly to a first locking position after the working end has been rotated to the first position and move linearly to a second locking position after the working end has be rotated to the second position.

6. The driver of claim 5, wherein the guide groove further comprises a longitudinal portion that corresponds with the first locking position and a transverse portion that corresponds with the second locking position.

7. The driver of claim 6, wherein the working end further comprises a second projection on a side opposite of the first projection, and wherein one of the first shell and the second shell has a first housing portion with a first groove extending longitudinally along the respective first shell and the second shell followed by a first detent, and wherein the one of the first shell and the second shell further having a second housing portion with a second groove extending transversely across the respective first shell and second shell followed by a second detent, and wherein the second projection on the working end engages the first detent when the working end is in the first locking position, and wherein the second projection on the working end engages the second detent when the working end is in the second locking position.

8. The driver of claim 7, and further comprising a hinge connecting the first shell and the second shell, wherein one of the first shell and the second shell of the handle has a recess on the end opposite to the hinge corresponding with the projection on the working end, and the recess can receive the projection.

9. The driver of claim 6, and further comprising a locking device that urges the working end to move with respect to the connector to move the working end to one of the first locking position and the second locking position.

10. The driver of claim 9, wherein the locking device further comprises a locating member and a resilient member, wherein the locating member is L-shaped and contact with the resilient member.

11. The driver of claim 5, wherein one of the first shell and the second shell of the handle has a depression for receiving the connector to combine the working end to the respective first shell and second shell.

12. The driver of claim 11, further comprising a transverse groove that is open to the respective first shell and second shell at one end and extends toward the depression, and a pair of detents with one detent on each side of the transverse groove, and wherein the working end further comprises a pair of projections with one projection on each side of the bar, and wherein the pair of projections on the working end engage the pair of detents on the respective first shell and second shell of the handle when the working end is in the second locking position.

13. The driver of claim 12, and further comprising a hinge connecting the first shell and the second shell, wherein one of the first shell and the second shell of the handle has a recess on the end opposite to the hinge corresponding with the projection on the working end, and the recess can receive the projection.

14. The driver of claim 1, wherein one of the first shell and the second shell of the handle has a positioning hole for constraining the working end in the first position or the second position.

15. The driver of claim 1, wherein one of the first shell and the second shell of the handle has a housing portion for receiving interchangeable driver heads.

16. The driver of claim 1, and further comprising three locking mechanisms to secure the working end to the handle in the first position.

17. The driver of claim 16, wherein a first locking mechanism of the three locking mechanisms comprises a projection on working end 2 that engages a recess in one of the first shell and the second shell of the handle, wherein a second locking mechanism of the three locking mechanisms comprises a bar on the working end that engages a positioning hole in one of the first shell and the second shell of the handle, and a third locking mechanism of the three locking mechanisms comprises a projection on the working end that engages a detent in one of the first shell and the second shell of the handle.

* * * * *